US005836194A

United States Patent [19]

Micouleau et al.

[11] Patent Number: 5,836,194

[45] Date of Patent: Nov. 17, 1998

[54] PORTABLE TUBE-BENDING MACHINE

[75] Inventors: Jean-Pierre Micouleau, Beautiran, France; Gerald Sauder, St. Louis, Mo.

[73] Assignee: Grover Machine Co., St. Louis, Mo.

[21] Appl. No.: 549,980

[22] Filed: Oct. 30, 1995

[51] Int. Cl.[6] ..... B21D 9/04

[52] U.S. Cl. ..... 72/307; 72/370.04; 72/370.19

[58] Field of Search ..... 72/307, 370, 451, 72/449, 421, 370.01, 370.04, 370.19; 29/890.149

[56] References Cited

U.S. PATENT DOCUMENTS

| | | | |
|---|---|---|---|
| 706,030 | 8/1902 | Cunin | 72/307 |
| 1,020,028 | 3/1912 | Dymond | 72/307 |
| 1,517,678 | 12/1924 | Holub | 72/307 |
| 2,104,993 | 1/1938 | Holub | 72/307 |
| 3,071,176 | 1/1963 | Askinazy | 72/449 |
| 3,670,553 | 6/1972 | Nothum | 72/307 |
| 3,861,184 | 1/1975 | Knudson | 72/307 |
| 4,198,842 | 4/1980 | Pawlaczyk | 72/307 |

*Primary Examiner*—Daniel C. Crane
*Attorney, Agent, or Firm*—Kalish & Gilster

[57] ABSTRACT

A portable tube-bending machine for receiving a length of tubular material 10 and repeatedly crimping the length of tubular material 10 to form an elbow. It includes a so-called toggle assembly 24, a carriage assembly 70 and an operating shaft assembly 50, all being movably mounted to a framework assembly 15. Operating shaft assembly 50 is operatively connected to sequentially actuate movement in toggle assembly 24 and carriage assembly 70. Outer die elements 28, 29, and 30, are movably mounted to toggle assembly 24 and adapted to crimp tubular material 10 by crimping it against an inner die 26. Carriage assembly 70 engages tubular material 10 and induces lengthwise movement relative to framework assembly 15 along the axis of the length of the tubular material 10.

16 Claims, 9 Drawing Sheets

PORTABLE TUBE-BENDING MACHINE

BACKGROUND

This invention relates to a portable tube-bending machine, and more particularly to a manually operated portable tube-bending machine for receiving a length of tubular material and repeatedly crimping the length of tubular material to form an elbow, as for guttering and downspout use.

Tube-bending or elbow-forming machines have been known for many years. An example is set forth in Nothum et al. U.S. Pat. No. 3,670,553. Such preexisting tube-bending machines typically have had inherent limitations, either because of their complexity, inability to consistently produce satisfactory elbow formations and/or lack of ready portability. In addition, known machines have not been easy to rebuild or repair, owing to their size and complexity and time-consuming procedures needed for disassembly and reassembly.

In the manufacture of tubular elbows, such as in the replacement or installation of guttering and downspouts on buildings, accurate dimensions are rarely available in advance. As a result, much cutting and bending of tubular elbows takes place on site in the field. However, many of these existing manually operated portable tube-bending machines are known to impart imprecise crimps to the tubular material resulting in unsatisfactory elbow formations that may not be usable and may have to be discarded. Moreover, any unsatisfactory elbow formations that have to be discarded increase the amount of waste associated with a particular project.

Many of the existing manually operated portable tube-bending machines also involve a several-step process which includes in one step the crimping of the tubular material and in a separate step the advancement of the tubular material prior to a subsequent additional crimping. Consequently, such a process is labor intensive and results in an increase in the amount of labor associated with a particular project.

What is needed is a manually operated portable tube-bending machine that in a single cycle imparts a precise crimp to the tubular material and advances the tubular material into position for imparting a subsequent additional precise crimp, if desired.

SUMMARY OF THE INVENTION

This invention satisfies the above needs. A novel manually operated portable tube-bending machine is provided.

Accordingly, among the several advantages and related objects of the invention are the provisions of a novel tube-bending machine which is readily portable, is easily used on site in the field, e.g., at a job site, and which accurately, quickly and precisely forms elbows such as those used in guttering and downspouts.

The new portable tube-bending machine includes adjustment features which do not limit the elbows formed to a 45 degree or 30 degree configuration. Elbows may also be formed directly on one or both ends of a length of tubular material and thus one-piece offsets can be manufactured to conform accurately with field dimensions. Another advantage of the present machine is that short lengths of tubular material, which may otherwise be scrapped, may be utilized to form elbows.

The versatility of the machine permits rectangular tubular material to be bent about either the major or minor axis simply by changing the dies. The machine is also adaptable to the bending of either rectangular or circular tubing material.

The machine is simple and easy to operate in the shop or in the field and the elbows may be formed of painted or unpainted tubular material. The elbows are of high quality and may be manufactured with a considerable saving in labor, thereby resulting in reduced final project costs.

A version of the portable tube-bending machine for receiving a length of tubular material and repeatedly crimping the length of tubular material to form an elbow, comprises: a framework means, a carriage means movably mounted to the framework means and adapted to engage the length of tubular material and induce lengthwise movement relative to the framework means along an axis the length of the tubular material, a set of rollers mounted to the carriage means, an operating shaft means mounted to the framework means and operatively connected to a toggle means and the carriage means, whereby to sequentially actuate the toggle means and advance the carriage means, a die means movably mounted to the toggle means and adapted to crimp the length of tubular material, the die means includes inner and outer die elements, the outer die elements are carried by the toggle means, a rack and pinion means operatively connecting the operating shaft means and the toggle means, a ratchet drive means operatively connecting the operating shaft means and the carriage means, and a ratchet drive-release means mounted to the framework means.

Other advantages, objects, and features will be in part apparent and in part pointed out below.

BRIEF DESCRIPTION OF THE DRAWINGS

Corresponding reference characters indicate corresponding parts throughout the several views of the drawings.

DESCRIPTION OF A SPECIFIC EMBODIMENT

Figure 1:
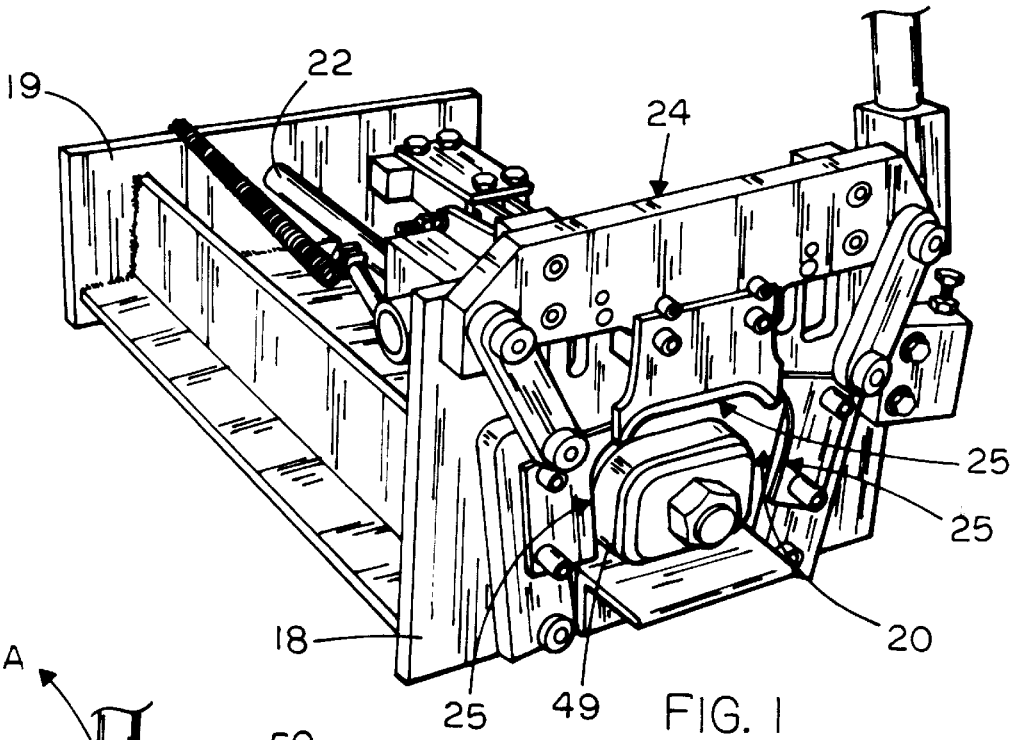
FIG. 1 shows a perspective view of a portable tube-bending machine in accordance with an embodiment of the invention, illustrating a framework assembly with a portion of the operating shaft assembly removed and the toggle assembly in the foreground.

Referring to the accompanying drawings, the new portable tube-bending machine includes a framework means or assembly 15, an operating shaft means or assembly 50, a so-called toggle means or assembly 24, a carriage means or assembly 70 and a manipulating element 95.

Figure 5:
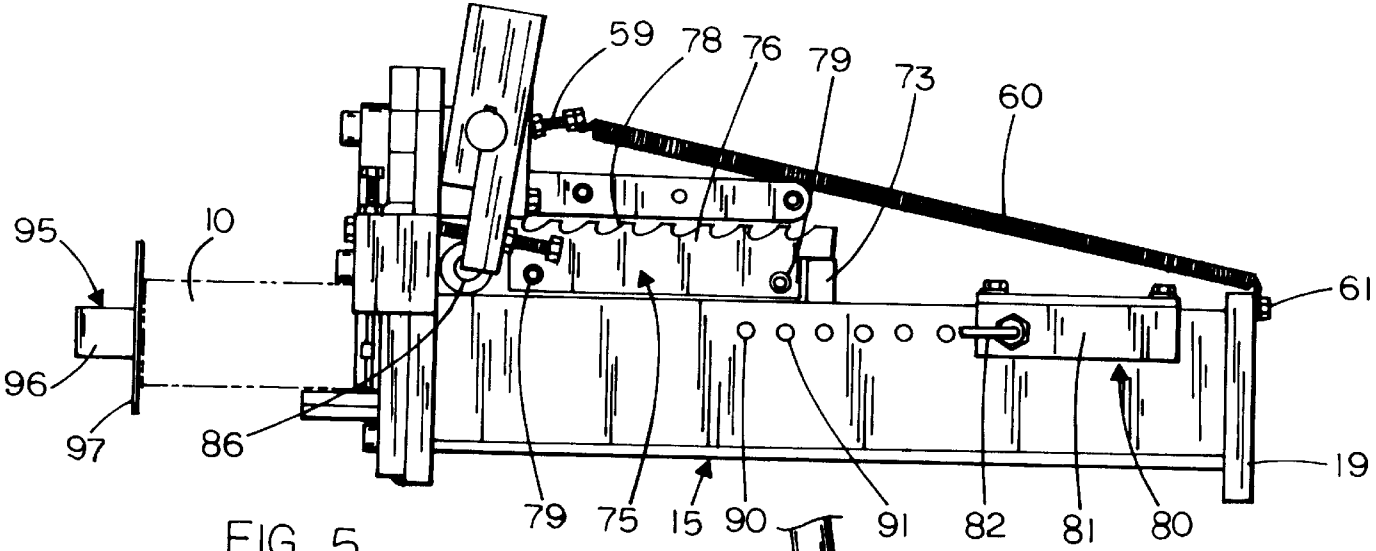
FIG. 5 shows a side elevation view illustrating the limit assembly mounted along the lengthwise side of the framework assembly and the ratchet drive assembly.
Figure 6:
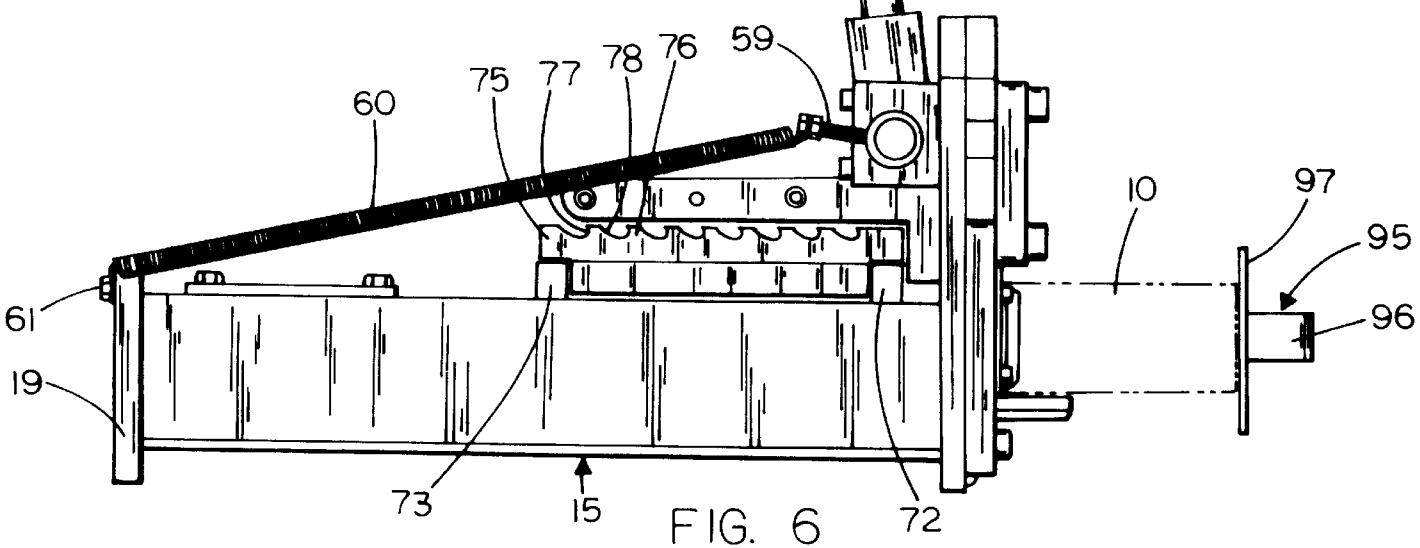
FIG. 6 shows a side elevation view illustrating the spring-recoil assembly and the ratchet drive assembly.
Figure 7:
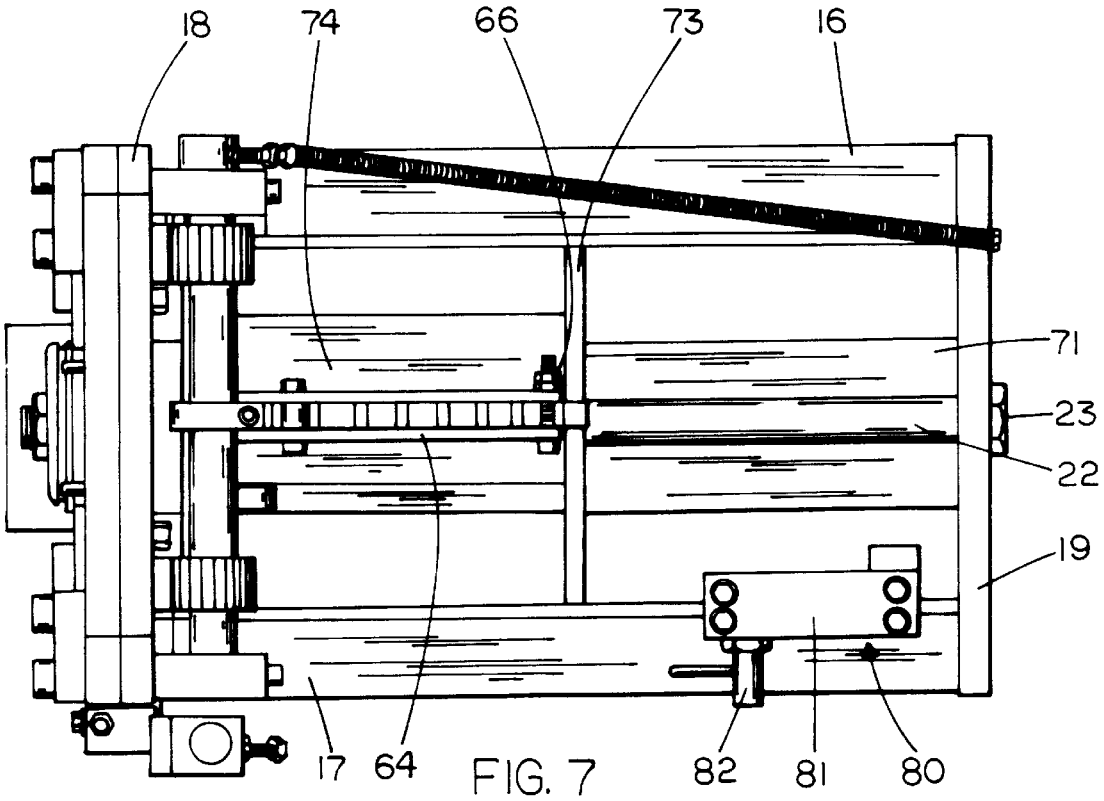
FIG. 7 shows a top plan view of the invention.
Figure 8:
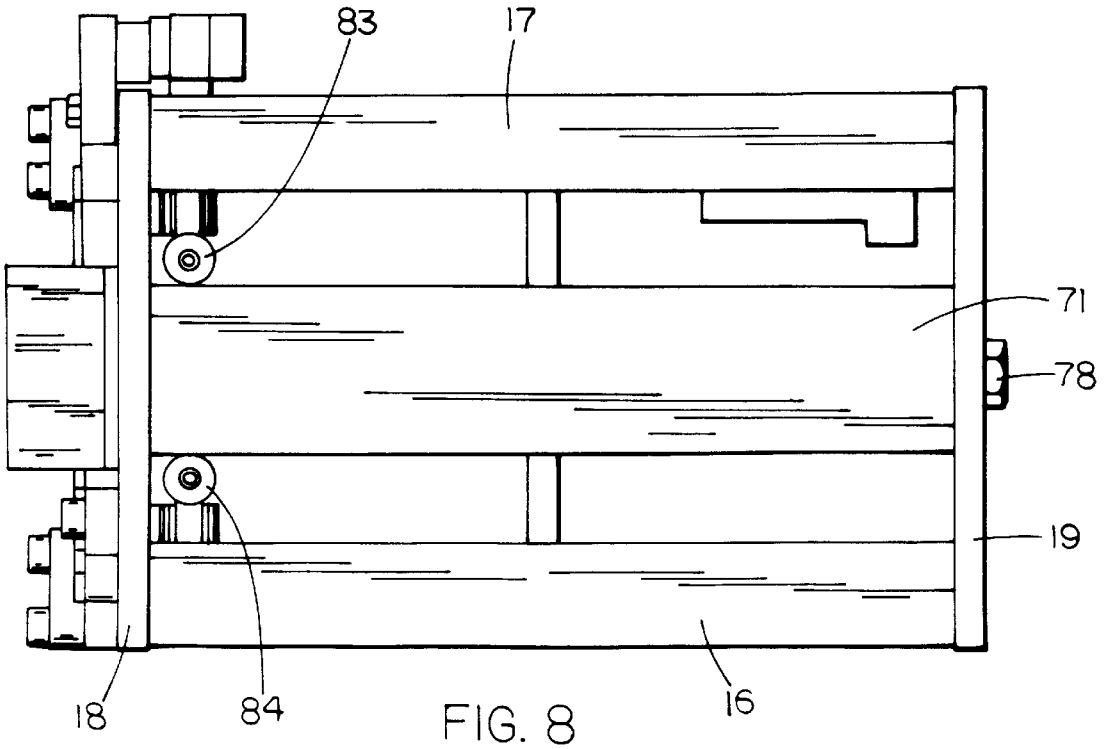
FIG. 8 shows a bottom plan view of the invention.

FIGS. 5 and 6 show a length of tubular material 10 received within framework assembly 15. Tubular material 10 is subjected to a succession of crimping actions resulting in the bending of the length of tubular material 10 in a curved configuration, the angle of curve depending on the number of crimps formed.

Framework assembly 15 includes opposed side plates 16 and 17. Front and rear end plates 18 and 19 respectively extend between and are connected to opposed side plates 16 and 17, as by welding, to provide an overall framework-like structure. An aperture 20 is provided in front end plate 18.

Figure 9:
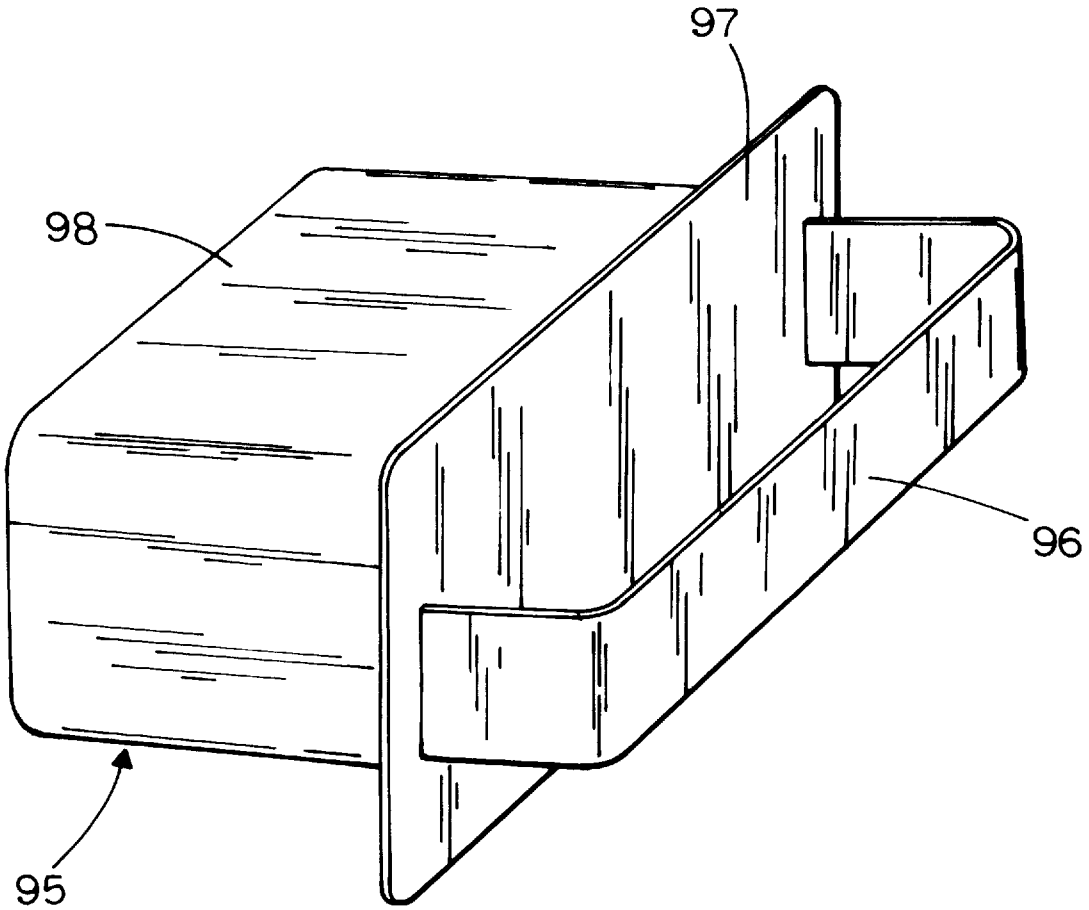
FIG. 9 shows a perspective view of the manipulating element.
Figure 10:
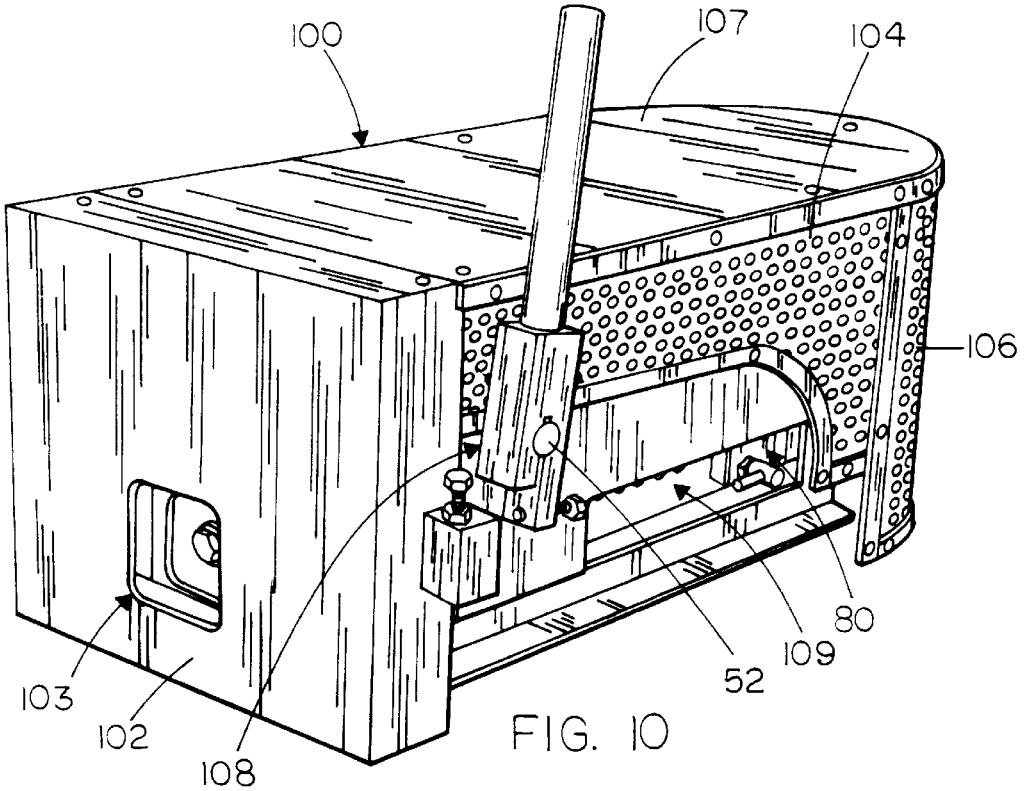
FIG. 10 shows a perspective view from the front left side of the enclosure.
Figure 11:
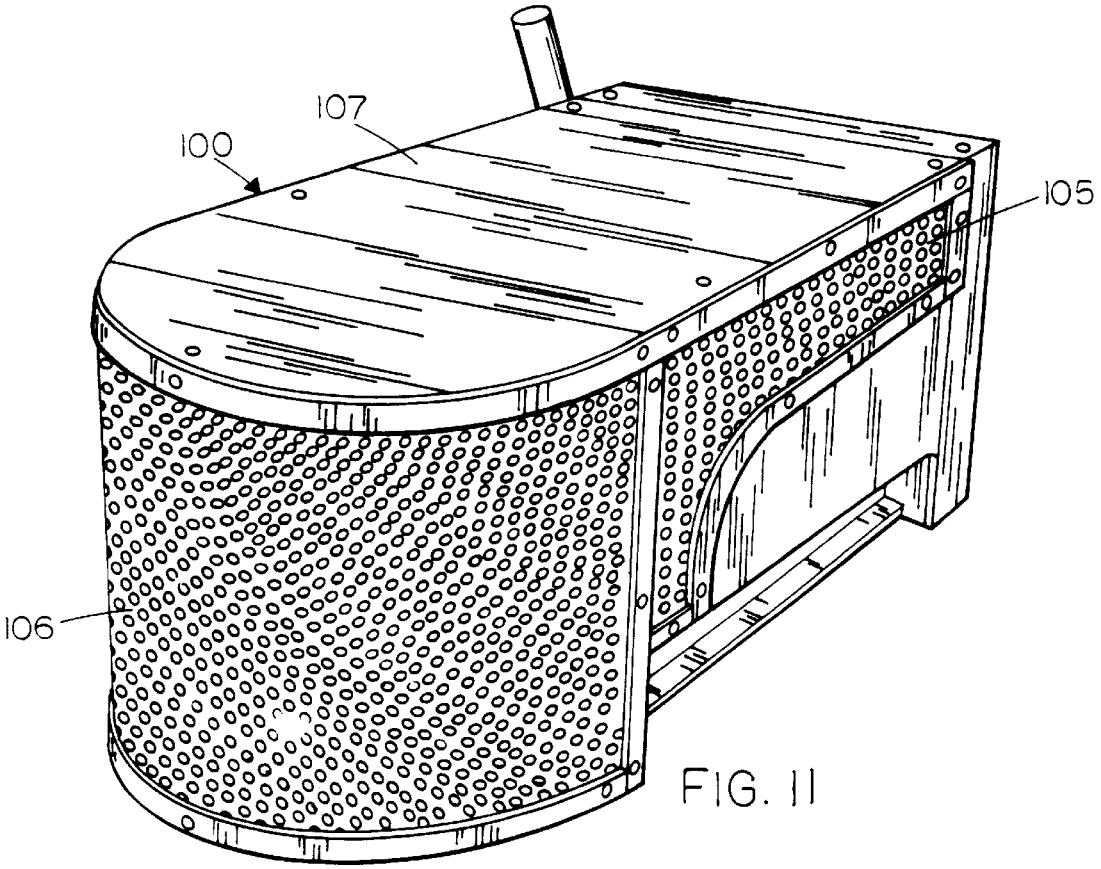
FIG. 11 shows a perspective view from the rear right side of the enclosure.
Figure 12:
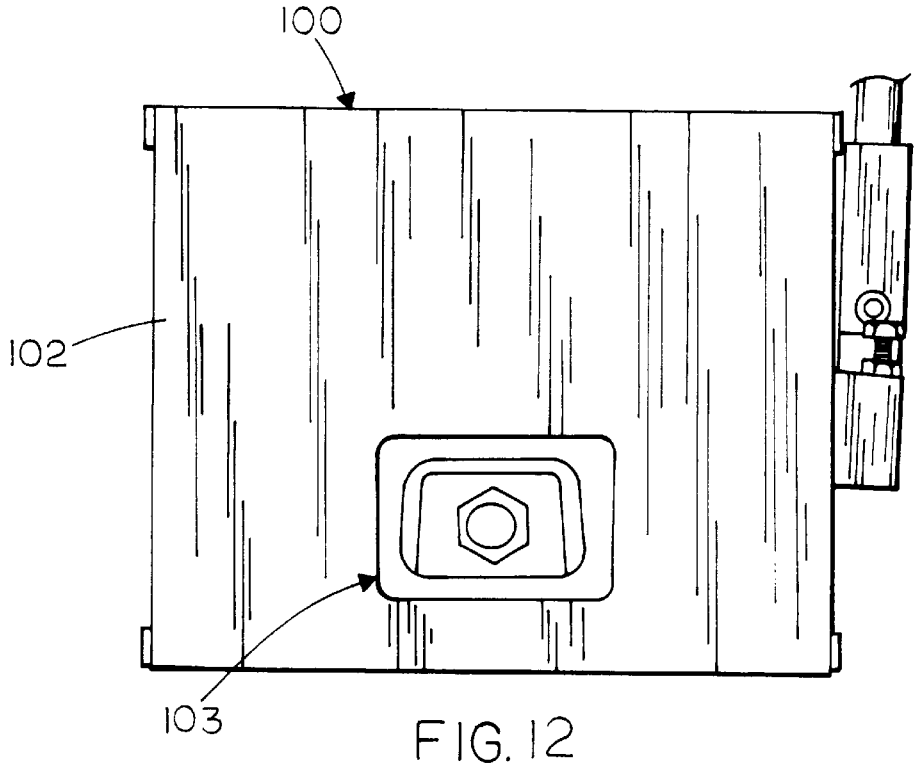
FIG. 12 shows a front view of the enclosure.
Figure 13:
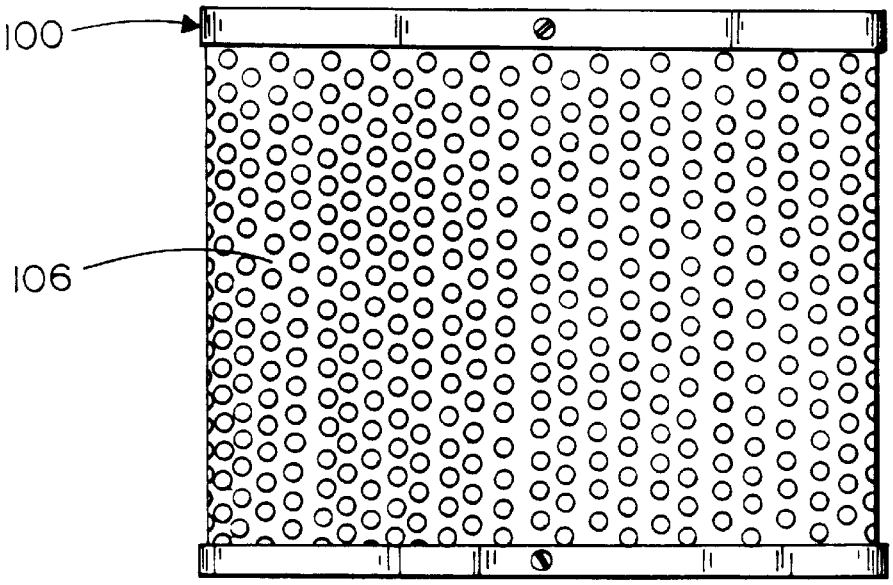
FIG. 13 shows a rear view of the enclosure.
Figure 14:
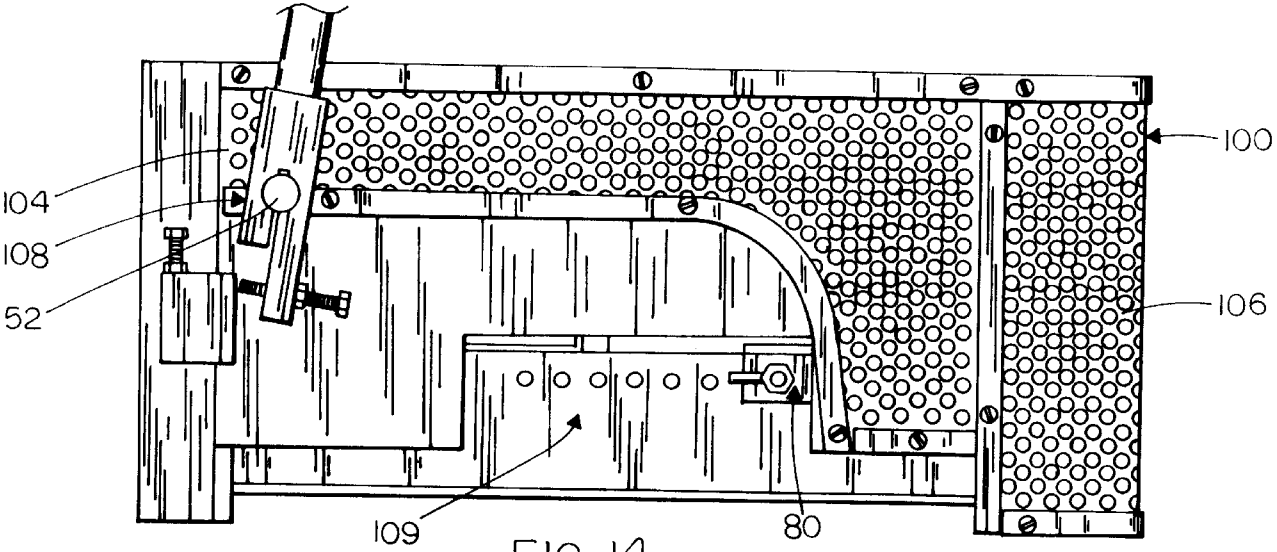
FIG. 14 shows a side view of the enclosure taken from the left-hand side of FIG. 12.
Figure 15:
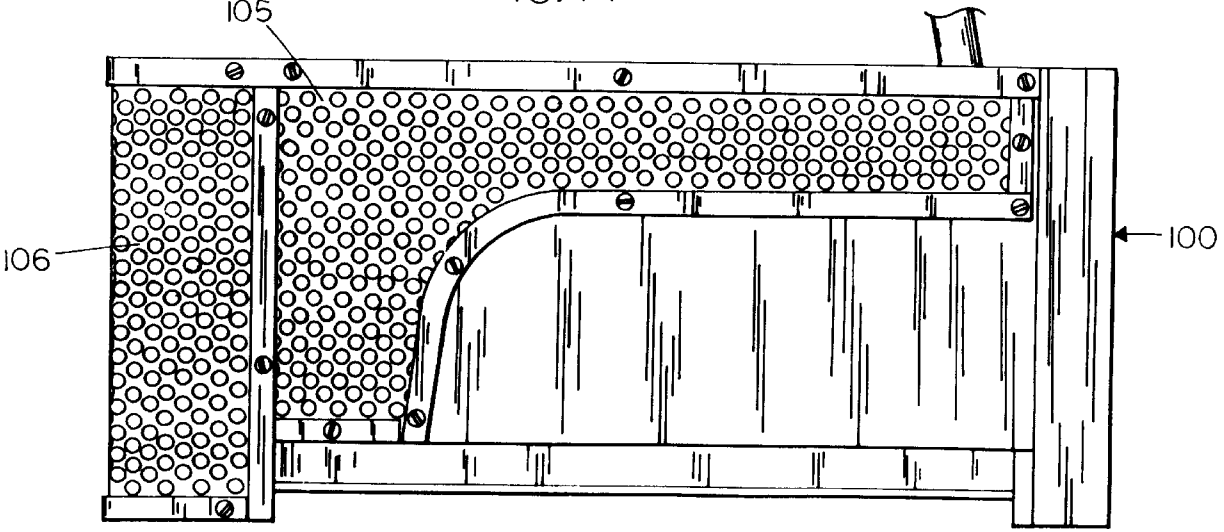
FIG. 15 shows a side view of the enclosure taken from the right-hand side of FIG. 12.
Figure 16:
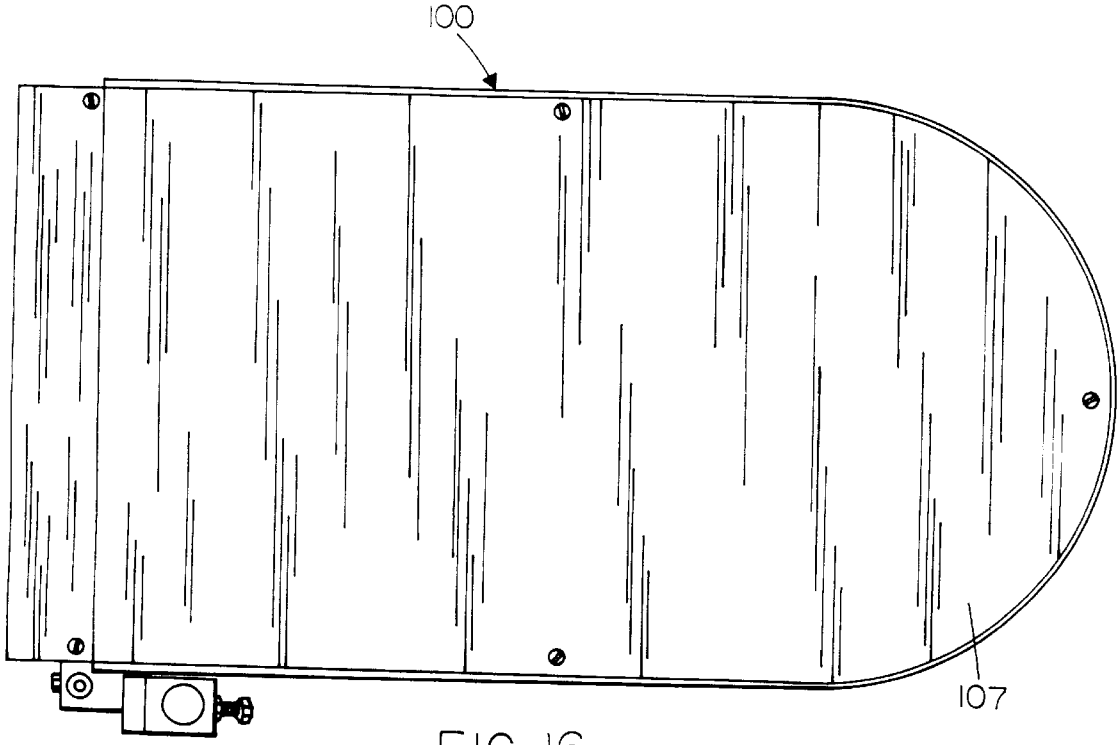
FIG. 16 shows a top view of the enclosure.
Figure 17:
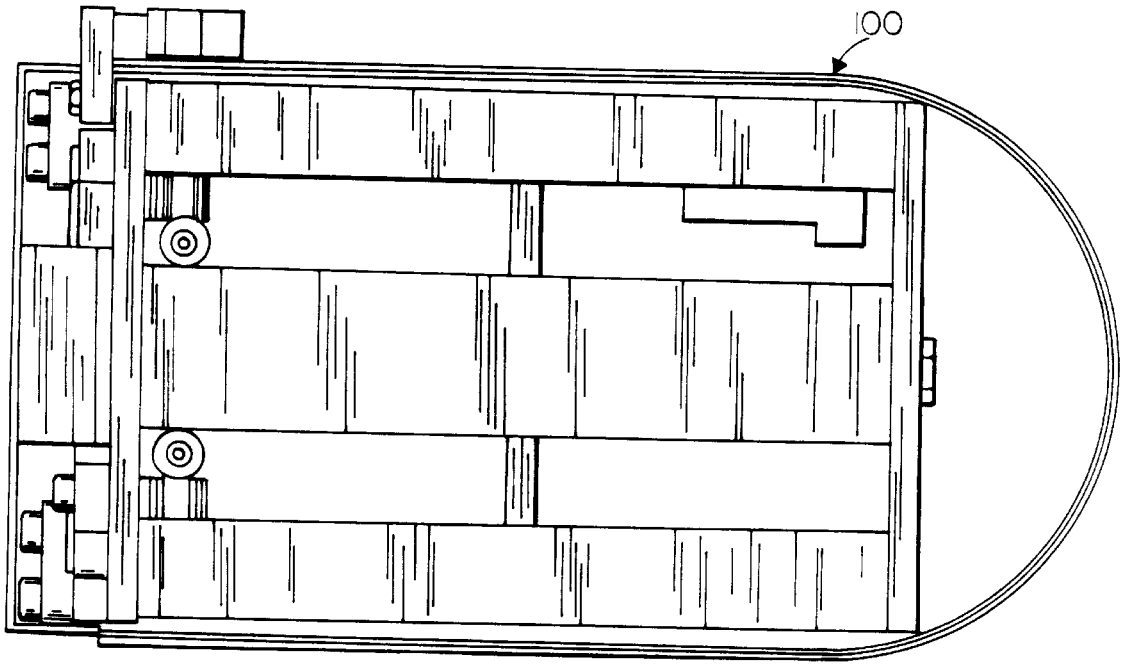
FIG. 17 shows a bottom view of the enclosure.

FIG. 9 shows manipulating element 95 having a grip handle 96, a plate 97 and an abutment 98. Abutment 98 is adapted to be inserted into an open end of the length of tubular material 10 until plate 97 comes into contact with the end of the length of tubular material 10. The opposite end of the length of tubular material 10 is inserted into the invention through aperture 20 and is pushed into place by using grip handle 96 until carriage assembly 70 achieves a predetermined position.

Carriage assembly 70 is slidably mounted for fore and aft movement within framework assembly 15 on a single guide rail 71 which extends between front and rear end plates 18 and 19. Guide rail 71 is held in place as by welding to respective front and rear end plates 18 and 19. Carriage assembly 70 is equipped with a set of rollers, four of which guide fore and aft movement of carriage assembly 70 along guide rail 71. Rollers 83 and 84 travel along the sides of guide rail 71. Roller 85 is one of two corresponding rollers which travels along the top of guide rail 71, it being understood that the second corresponding roller is similarly positioned on the opposite side of carriage assembly 70. Carriage assembly 70 includes front and rear transverse plates 72 and 73 connected by a top strut 74. A rack or rack element 75, having a plurality of teeth 76 providing consecutive notches, extends between and is connected to transverse plates 72 and 73 as by a pair of fasteners 79.

The extent to which the length of tubular material 10 is bent is determined by the number of times the crimping action is applied as carriage assembly 70 is sequentially advanced. The advance of carriage assembly 70 is in relation to the number of rack teeth 76 engaged by a ratchet drive means or assembly 62. The starting point of carriage assembly 70 is set by a limit means or assembly 80 which adjustably engages side plate 17. Limit assembly 80 consists of a limit block 81 and a limit pin 82. Limit block 81 is secured in a predetermined position on side plate 17 by passing limit pin 82 through any one of a plurality of apertures positioned on side plate 17.

Carriage assembly 70 provides intermediate support for a die rod 22 which is attached to rear end plate 19 by means of a nut 23. At its remote end, die rod 22 carries an inner die element 26 which is attached to die rod 22 by means of a nut 27. It will be understood that inner die element 26 is adapted to receive tubular material 10 and that inner die element 26 is, for this reason, peripherally spaced from the from front end plate aperture 20. Carriage assembly 70 provides the necessary support for the relatively long die rod 22 to effectuate this peripheral spacing.

Figure 3:
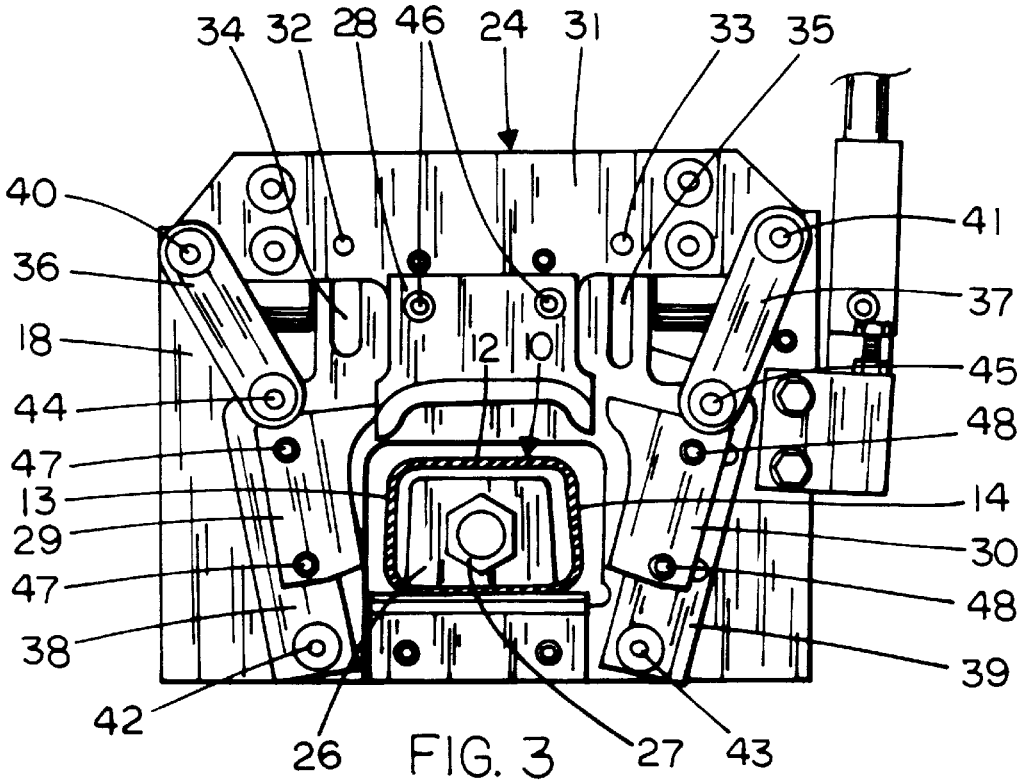
FIG. 3 shows an end elevation view with the toggle assembly in place and illustrating the inner die set-up for bending a rectangular tube about its major axis.
Figure 4:
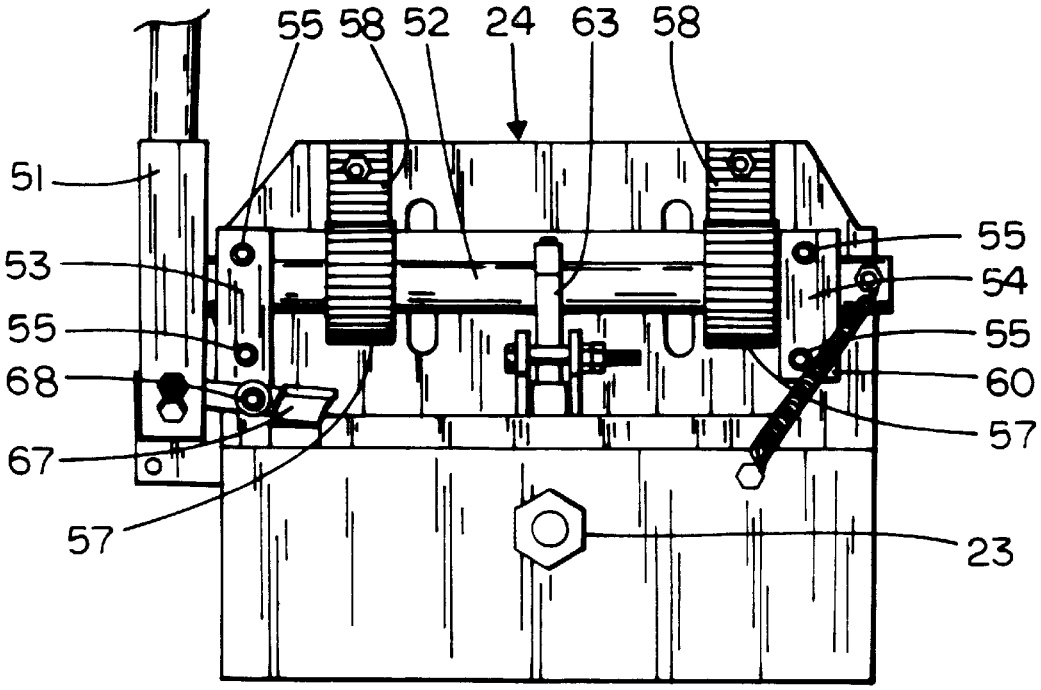
FIG. 4 shows an end elevation view illustrating the nut securing the die rod to the framework assembly and a portion of the operating shaft assembly.

A die set 25, constituting die means, includes, in addition to inner die element 26, a plurality of outer die elements. These outer die elements are carried by toggle assembly 24 and include an upper die element 28 and a pair of opposed side die elements 29 and 30. Toggle assembly 24, which is clearly indicated in FIG. 3, includes a first, upper link 31 mounted in slidable relation to front end plate 18 by means of threaded fasteners 32 and 33. Threaded fastener 32 is slidably received for reciprocating travel in a slot 34 provided in front end plate 18. Threaded fastener 33 is slidably received for reciprocating travel in a slot 35 provided in front end plate 18. Upper link 31 is pivotally connected at its end to opposed pairs of side toggle link elements 36 and 37, and 38 and 39. Each of the upper toggle link elements 36 and 37 is pivotally connected to upper link 31 at associated ends thereof by pivot pins 40 and 41 respectively and each of the lower toggle link elements 38 and 39 is pivotally connected to end plate 18 by pivot pins 42 and 43. Associated toggle elements 36 and 38 are pivotally connected to each other by a pivot pin 44, and associated toggle elements 37 and 39 are likewise pivotally connected by a pivot pin 45. With this arrangement, reciprocating vertical translational movement of upper link 31 results in inward rotation of lower toggle link elements 38 and 39 about pins 42 and 43 respectively.

Upper die element 28 is detachably attached by a pair of fasteners 46 to upper link 31 and side die elements 29 and 30 are detachably attached to lower toggle link elements 38 and 39 respectively as by fasteners 47 and 48. Thus, as upper die element 28 is depressed, side die elements 29 and 30 move inwardly, and thus each outer die element is urged toward inner die element 26.

When the side walls of the length of tubular material 10 are interposed between inner and outer die elements, the upper wall and side walls 12, 13 and 14 respectively of tubular material 10, will be crimped by outer die elements 28, 29 and 30 which are received into the compatible U-shaped groove formation 49 provided on inner die element 26. This crimping action results in the upward bending of tubular material 10 and, when outer die elements 28, 29 and 30 are reciprocated out of contact with tubular material 10, forward pressure applied to tubular material 10 by carriage assembly 70, results in the crimped portion of tubular material 10 being urged against the front of groove 49 and folded rearwardly.

Cyclical reciprocating movement is induced into toggle assembly 24 by means of operating shaft assembly 50, which also actuates the forward movement of carriage assembly 70. operating shaft assembly 50 includes an operating handle 51 which is detachably secured to a rotatable shaft 52. Rotatable shaft 52 is mounted to front end plate 18 by a pair of guide blocks 53 and 54. Guide blocks 53 and 54 are connected to front end plate 18 by threaded fasteners 55. A pair of pinions 57 are precisely positioned on rotatable shaft 52 such that when operating handle 51 is moved from the vertical in the direction of A in FIG. 2, pinions 57 engage a pair of racks 58 and lower toggle assembly 24 in a guided uniform motion resulting in a precise crimp to the length of tubular material 10.

Located at the end of rotatable shaft 52 opposite operating handle 51 is a fastener 59. Attached to fastener 59 is a spring 60. The opposite end of spring 60 is secured to rear end plate 19 by fastener 61. Spring 60 assists in maintaining operating handle 51 in the vertical position.

A ratchet link 63 is also secured to rotatable shaft 52. A ratchet drive 64 is attached to ratchet link 63 by a pin 65. At the end of ratchet drive 64 opposite ratchet link 63 is a pin 66. Pin 66 is selectively engagable with the rear face 77 of each ratchet tooth 76 such that when operating handle 51 is returned from position A in FIG. 2 to the vertical, pin 66 engages a ratchet tooth 76 applying pressure to the rack element 75 and pulling carriage assembly 70 forward. It will be understood that pin 66 rides up the inclined forward face 78 of each tooth 76 when operating handle 51 is moved in the direction of A as in FIG. 2.

A ratchet lift arm 67 is secured to front end plate 18 by means of a fastener 68. A roller 86 is secured to front transverse plate 72. As carriage assembly 70 advances toward front end plate 18, roller 86 will contact ratchet lift arm 67 and lift one end of ratchet lift arm 67 while concurrently lowering the opposite end of ratchet lift arm 67. The end of ratchet lift arm 67 so lowered allows operating handle 51 to pass vertical when moved in the direction of B in FIG. 2. The moving of operating handle 51 in the direction of B past vertical allows for ratchet drive 64 to be raised and disengaged from ratchet teeth 76.

FIGS. 10 through 17 show an enclosure 100 having a front face 102 with aperture 103 for receiving the length of tubular material 10, side walls 104 and 105 extending rearwardly to a rounded rear wall 106, and a top 107. Side openings are provided on side wall 104 at 108 for rotatable shaft 52 to extend therethrough and at 109 for access to limit assembly 80. Enclosure 100 is formed of suitable stainless steel, steel, steel alloy, plastic or other suitable material capable of maintaining its shape and enclosingly protecting the operative elements of the portable tube-bending machine.

Figure 2:
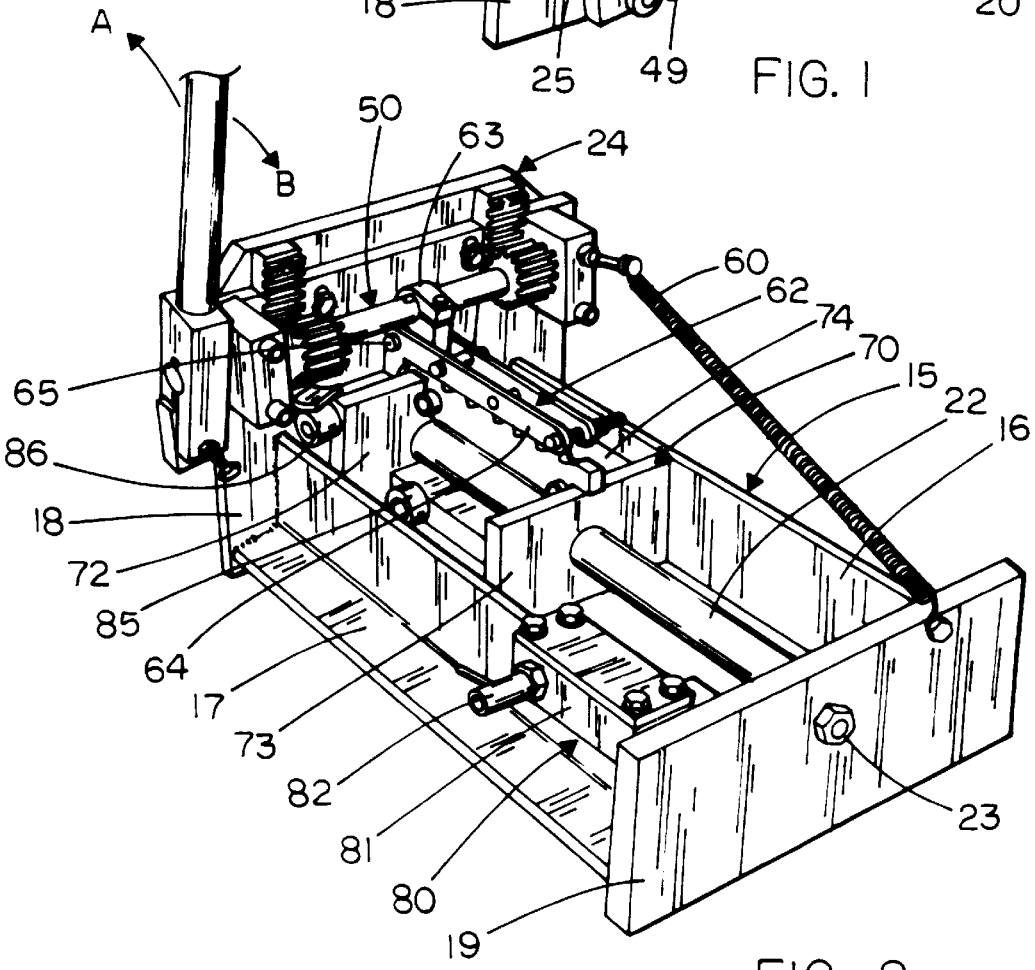
FIG. 2 shows a perspective view of the framework assembly with a portion of the operating shaft assembly removed and illustrating the carriage assembly and the limit assembly.

The bending operation is initiated by inserting the length of tubular material 10 over inner die element 26 and through aperture 20 until the length of tubular material 10 abuts front transverse plate 72 of carriage assembly 70. The toggle assembly 24 is actuated by moving the operating handle 52 in the direction of A as shown in FIG. 2. As the toggle assembly 24 is actuated, the outer die elements 28, 29 and 30 move inwardly and crimp the tube walls 12, 13 and 14 into U-shaped groove formation 49 provided on inner die element 26. The application of this crimping force to only three walls of the length of tubular material 10 forces said tubular material 10 to curve upwardly. The movement of operating handle 52 back to vertical moves the outer die elements 28, 29 and 30 out of engagement with the length of tubular material 10 and initiates the second phase of the crimping operation. During this second phase, pin 66 attached to ratchet drive 64 is selectively engagable with the rear face 77 of each ratchet tooth 76 and force is thereby applied to the carriage assembly 70. This applied force advances the tubular material 10 outwardly from the framework assembly a distance equal to the spacing between the individual teeth of the rack which pin 66 is in direct contact. This action relocates the length of tubular material 10 for further crimping and pushes the already crimped portion of the tubular material 10 over the front edge of the inner die groove 49, thereby folding the crimped material rearwardly. A sequence of crimping and advancing thus produces a curbed tubular material.

It will be understood that the greater the number of crimping actions applied to tubular material 10, the greater will be the angle to which the tubular material is curved. Thus, for example, if 5 crimps produce a 45 degree curve, 7 crimps will produce a 63 degree curve and so on.

It is an advantage to provide a means of presetting the starting point of the carriage assembly 70 so that the length of tubular material 10 will not be curved more than a desired amount. In a specific embodiment, this is accomplished by a limit assembly 80 which includes a limit block 81 and a limit pin 82. Limit block 81 engages side wall 17 of framework assembly 15 and is secured in a predetermined position by limit pin 82. Looking at FIG. 5 and apertures identified as 90 and 91, the difference between apertures 90 and 91 and the succeeding apertures is related to a given number of tooth spaces. Thus, when the carriage assembly 70 is pushed backward until it comes in contact with limit block 81 secured by limit pin 82 in aperture 90, for example, the range of advancement experienced by carriage assembly 70 and the length of tubular material 10 will be such that a 9 degree curve will be applied to the length of tubular material 10. If, for example, carriage assembly 70 is pushed backward until it comes into contact with limit block 81 secured by limit pin 82 in aperture 91, the range of advancement experienced by carriage assembly 70 and the length of tubular material 10 will be such that a 18 degree curve will be applied to the length of tubular material 10. Greater amounts of curvature may be achieved by engaging limit block 81 with limit pin 82 in succeeding apertures located on side 17 of framework assembly 15.

When the last crimp is applied to the length of tubular material 10, roller 86 comes into contact with ratchet lift arm 67 causing one end of ratchet lift arm 67 to be raised and the other end to be lowered. The side of ratchet lift arm 67 so lowered allows operating handle 51 to pass vertical when moved in the direction of B as shown in FIG. 2 thus disengaging ratchet drive 64 from ratchet teeth 76. Thus, the length of tubular material 10 may be removed and limit block 81 may, if desired, be reset for increasing or decreasing the angle of curvature for the next length of tubular material to be crimped.

In view of the foregoing description of the present invention and embodiment disclosed, it will be seen that the several objects of the invention are achieved and other advantages are attained.

As various modifications could be made in the constructions and methods herein described and illustrated without departing from the scope of the invention, it is intended that all matter contained in the foregoing description or shown in the accompanying drawings shall be interpreted as illustrative rather than limiting.

Thus, the breadth and scope of the present invention should not be limited by any of the above-described exemplary embodiments, but should be defined only in accordance with the following claims appended hereto and their equivalents.

What is claimed is:

1. A portable tube-bending machine for receiving a length of tubular material and repeatedly crimping the length of tubular material to form an elbow, comprising a framework means, a carriage means movably mounted to the framework means and adapted to engage the length of tubular material and induce lengthwise movement relative to the framework means along an axis the length of the tubular material, a set of rollers mounted to the carriage means, an operating shaft means mounted to the framework means and operatively connected to a toggle means and the carriage means, whereby to sequentially actuate the toggle means and advance the carriage means, a die means movably mounted to the toggle means and adapted to crimp the length of tubular material, the die means includes inner and outer die elements, the outer die elements are carried by the toggle means, a rack and pinion means operatively connecting the operating shaft means and the toggle means, a ratchet drive means operatively connecting the operating shaft means and the carriage means, and a ratchet drive-release means mounted to the framework means.

2. A portable tube-bending machine according to claim 1 wherein a pair of rack-and-pinion means each comprising a respective pinion carried by the operating shaft meshing with a respective rack carried by the toggle means.

3. A portable tube-bending machine as set forth in claim 1 in combination with a manipulating element for manipulating the length of tubular material comprising a grip handle and a plate carrying an abutment extending in a direction from the plate for being received by the length of tubular material.

4. A portable tube-bending machine as set forth in claim 1, comprising an enclosure for enclosingly protecting the operative elements of the portable tube-bending machine, the enclosure defining an opening at the front portion thereof for receiving the length of tubular material.

5. An enclosure as set forth in claim 4, having an aperture and extending therefrom the rotatable shaft.

6. An enclosure as set forth in claim 4, having an aperture providing access to a limit assembly.

7. A portable tube-bending machine for receiving a length of tubular material and repeatedly crimping the length of tubular material during crimping cycles to form therefrom an elbow, the portable tube-bending machine comprising:

a framework;

a carriage carried by the framework for lengthwise forward and rearward movement relative to the framework along a lengthwise axis of the length of tubular material; the carriage including a front transverse plate at an inner end of the carriage for engaging an inner end of the length of tubular material;

a front end plate carried by the framework, the front end plate defining an opening for receiving the length of tubular material to be crimped;

an inner die carried by the framework in orientation to receive the length of tubular material with the inner die within the length of tubular material;

a plurality of outer die elements including an oppositely disposed pair of side die elements and an upper die element;

support structure affixed to the front plate for carrying the outer die elements around a peripheral portion of the length of tubular material in movable crimping relationship to the inner die;

an operating shaft including an operating device for causing rotation of the operating shaft in a crimping cycle, the operating shaft being transverse to the movement of the carriage and proximate the front end plate;

the operating shaft being selectively rotatable in a first direction of rotation or causing crimping and in an opposite direction of rotation for causing movement of the carriage, a toggle interconnecting the operating shaft with each of the outer die elements for causing precise crimping movement of the outer die elements relative to the inner die with precise mutually aligned crimping movement of the outer die elements whereby to produce a precise crimp in the length of tubular material by impingement of the plurality of the outer die elements with the peripheral portion of the length of tubular material;

a ratchet drive operatively interconnecting the operating shaft and the carriage for incrementally pulling the length of tubular material toward the front end plate during rotation in a crimping cycle of the operating shaft; and wherein each crimping cycle rotational movement of the operating shaft alternately crimps the length of tubular material and then causes the length of tubular material to be pulled toward the front end plate for a successive crimp, each crimp producing a predetermined extent of bending of the length of tubular material so as to form therefrom an elbow.

8. A portable tube-bending machine according to claim 7 wherein the ratchet drive comprises a ratchet link, a ratchet drive and a rack having ratchet teeth, the ratchet link being operatively interconnected with the operating shaft for causing advancement of the carriage toward the front end plate during one direction of the rotatable shaft by ratchet tooth engagement, and ratcheting movement relative to the ratchet teeth during an opposite direction of rotation of the operating shaft.

9. A portable tube-bending machine according to claim 8 wherein each crimping cycle produces a crimp, and further comprising a ratchet lift arm for disengaging the ratchet drive from the rack upon completion of a desired number of crimping cycles.

10. A portable tube-bending machine according to claim 9 wherein the ratchet lift arm when disengaging the ratchet drive carried by the carriage permits an additional extent of rotation of the operating shaft in the opposite direction of rotation when the carriage comes into a position of proximity to the front end plate.

11. A portable tube-bending machine according to claim 10 wherein the operating device is an operating arm connected to the operating shaft for selective rotation thereof the operating arm being rotated by the operating arm in a first direction from a starting position for crimping until reaching a crimp-completed position, and in an opposite direction back to the starting position for carriage advancement, the disengaging device operating to limit movement of the arm to the starting position until the carriage comes into a position of proximity to the front end plate, and permitting movement of the operating arm past the starting position with corresponding overrotation of the rotatable shaft upon the carriage coming into the position of proximity to the front end plate.

12. A portable tube-bending machine according to claim 7, further comprising a support carried by the framework for presenting the inner die to receive the length of tubular material.

13. A portable tube-bending machine according to claim 12, wherein the support is a single rod projecting from the framework.

14. A portable tube-bending machine according to claim 7, further comprising roller guides for guiding the carriage for precise movement within the framework.

15. A portable tube-bending machine for receiving a length of tubular material and repeatedly crimping the length of tubular material during crimping cycles to form therefrom an elbow, the portable tube-bending machine comprising:

a framework;

a carriage carried by the framework for lengthwise forward and rearward movement relative to the framework along a lengthwise axis of the length of tubular material; the carriage including a front transverse plate at an inner end of the carriage for engaging an inner end of the length of tubular material;

a front end plate carried by the framework, the front end plate defining an opening for receiving the length of tubular material to be crimped;

an inner die carried by the framework in orientation to receive the length of tubular material with the inner die within the length of tubular material;

a plurality of outer die elements including an oppositely disposed pair of side die elements and an upper die element;

support structure affixed to the front plate for carrying the outer die elements around a peripheral portion of the length of tubular material in movable crimping relationship to the inner die;

an operating shaft including an operating device for causing rotation of the operating shaft in a crimping cycle, the operating shaft being transverse to the movement of the carriage and proximate the front end plate;

a toggle interconnecting the operating shaft with each of the outer die elements for causing precise crimping movement of the outer die elements relative to the inner die with precise mutually aligned crimping movement of the outer die elements whereby to produce a precise crimp in the length of tubular material by impingement of the plurality of the outer die elements with the peripheral portion of the length of tubular material;

a ratchet drive operatively interconnecting the operating shaft and the carriage for incrementally pulling the length of tubular material toward the front end plate during rotation in a crimping cycle of the operating shaft; and wherein each crimping cycle rotational movement of the operating shaft alternately crimps the length of tubular material and then causes the length of tubular material to be pulled toward the front end plate for a successive crimp, each crimp producing a predetermined extent of bending of the length of tubular material so as to form therefrom an elbow;

wherein the toggle comprises a pair of rack-and-pinion assemblies each comprising a respective pinion carried by the operating shaft and a rack meshing with the pinion, and a linkage interconnecting the rack with a respective one of the side die elements.

16. A portable tube-bending machine according to claim 15 wherein the toggle comprises oppositely disposed links connecting the respective links to respective ones of the side die elements, and means interconnecting the upper die element to the side die elements.

* * * * *